US007383803B2

(12) United States Patent
Watanabe

(10) Patent No.: US 7,383,803 B2
(45) Date of Patent: Jun. 10, 2008

(54) VALVE TIMING CONTROL DEVICE FOR INTERNAL COMBUSTION ENGINE

(75) Inventor: Masahiko Watanabe, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/797,280

(22) Filed: May 2, 2007

(65) Prior Publication Data

US 2007/0204825 A1 Sep. 6, 2007

Related U.S. Application Data

(60) Division of application No. 10/765,105, filed on Jan. 28, 2004, now Pat. No. 7,228,830, which is a continuation of application No. 09/959,193, filed as application No. PCT/JP01/00576 on Jan. 29, 2001, now Pat. No. 6,832,585.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.31, 90.15
See application file for complete search history.

(56) References Cited

U.S. PATENT DOCUMENTS

| | | | | |
|---|---|---|---|---|
| 4,955,330 | A | 9/1990 | Fabi et al. | |
| 5,031,585 | A | 7/1991 | Muir et al. | |
| 5,117,785 | A * | 6/1992 | Suga et al. | 123/90.17 |
| 5,181,484 | A | 1/1993 | Kan et al. | |
| 5,181,486 | A | 1/1993 | Gyurovits | |
| 5,189,999 | A | 3/1993 | Thoma | |
| 5,203,291 | A | 4/1993 | Suga et al. | |
| 5,275,138 | A | 1/1994 | Hotta et al. | |
| 5,518,092 | A | 5/1996 | Ma | |
| 5,609,127 | A | 3/1997 | Noplis | |
| 5,704,316 | A | 1/1998 | Fujimoto et al. | |
| 5,724,929 | A | 3/1998 | Mikame et al. | |
| 5,743,155 | A | 4/1998 | Tortul | |
| 5,778,840 | A | 7/1998 | Murata et al. | |
| 5,941,202 | A | 8/1999 | Jung | |
| 6,289,860 | B1 | 9/2001 | Speckhart et al. | |

FOREIGN PATENT DOCUMENTS

| | | | |
|---|---|---|---|
| DE | 3933923 | A1 | 4/1991 |
| JP | 58-183907 | U | 12/1983 |
| JP | 60-63010 | U | 5/1985 |
| JP | 63-162910 | A | 7/1988 |
| JP | 5-059914 | A | 3/1993 |
| JP | 10-153104 | A | 6/1998 |

* cited by examiner

*Primary Examiner*—Zelalem Eshete
(74) *Attorney, Agent, or Firm*—Foley & Lardner LLP

(57) ABSTRACT

A valve timing control device includes a drive pulley driven by a crankshaft of an engine, and a driven camshaft. The camshaft has a cam that serves to open and close an intake port. An engine valve is spring-loaded by a valve spring, whereas the cam opens or closes the engine valve against the bias of the spring. Torque is transmittable between the drive pulley and the camshaft, and a rotation angle adjusting mechanism is provided therebetween. The rotation angle adjusting mechanism has a movable operating member being movable in a substantially radial direction.

11 Claims, 7 Drawing Sheets

VALVE TIMING CONTROL DEVICE FOR INTERNAL COMBUSTION ENGINE

RELATED APPLICATIONS

This application is a divisional of U.S. application Ser. No. 10/765,105, filed Jan. 28, 2004, which is a continuation of U.S. application Ser. No. 09/959,193, filed Oct. 19, 2001, now U.S. Pat. No. 6,832,585, which claims priority from PCT/JP2001/00576, filed Jan. 29, 2001, and published as WO 2002/061241. The entire contents of each of the aforementioned applications are incorporated herein by reference.

TECHNICAL FIELD

The invention relates to a valve timing control device for an internal combustion engine which variably controls valve-open and valve-closure timings of intake-port side and exhaust-port side engine valves, depending upon engine operating conditions.

BACKGROUND ART

A conventional valve timing control device has been disclosed in Japanese Patent Provisional Publication No. 10-153104.

Briefly speaking, in this conventional valve timing control device, a timing pulley (a driving rotational member), driven by a crankshaft of an engine, is coaxially installed on the outer periphery of a shaft member (a driven rotational member) integrally connected to a camshaft, and the timing pulley and the shaft member are coupled with each other via an installation-angle adjusting mechanism. The installation-angle adjusting mechanism is constructed mainly by a piston member (a movable operating member) that the relative rotation of the piston member to the timing pulley is restricted but the axial displacement of the piston member is permitted, and helical gears formed the inner peripheral wall surface of the piston member and the outer peripheral wall surface of the shaft member and being in meshed-engagement with each other. The installation-angle adjusting mechanism serves to adjust the installation angle between the timing pulley and the shaft member via the helical gears by moving the piston member in either one of axial directions by way of a control mechanism including electromagnets and a return spring.

The previously-noted conventional valve timing control device has the difficulty in holding the rotational phase against reaction force (alternating torque) caused by the engine valves. For this reason, in addition to the piston member, an electromagnetic clutch, used to hold the phase, is further provided.

It is, therefore, in view of the previously-described disadvantages of the prior art, an object of the present invention to provide a valve timing control device for an internal combustion engine which is capable of enhancing ease of assembly or mounting on the vehicle, while reducing the axial installation space occupied by the installation-angle adjusting mechanism.

It is another object of the present invention to provide a valve timing control device for an internal combustion engine which is capable of certainly holding a rotational phase against reaction force created by engine valves without providing a more complicated structure and using electromagnetic parts.

DISCLOSURE OF THE INVENTION

In order to accomplish the aforementioned and other objects, a valve timing control device of the invention comprises a driving rotational member driven by a crankshaft of an engine, an engine valve provided at an associated one of an intake port and an exhaust port for opening and closing the associated port, a valve spring biasing the engine valve in a direction closing of the associated port of the intake and exhaust ports, a driven rotational member including either one of a camshaft having a cam that opens the engine valve against a spring bias of the valve spring and a separate member integrally connected to and separable from the camshaft, and an installation-angle adjusting mechanism disposed between the driving and driven rotational members to transmit a torque of the driving rotational member to the driven rotational member and having a movable operating member that varies a relative-rotation phase between the crankshaft and the camshaft by way of movement of the movable operating member in a substantially radial direction of the camshaft depending on engine operating conditions.

The other objects and features of this invention will become understood from the following description with reference to the accompanying drawings.

DESCRIPTION OF THE PREFERRED EMBODIMENTS

Figure 1:
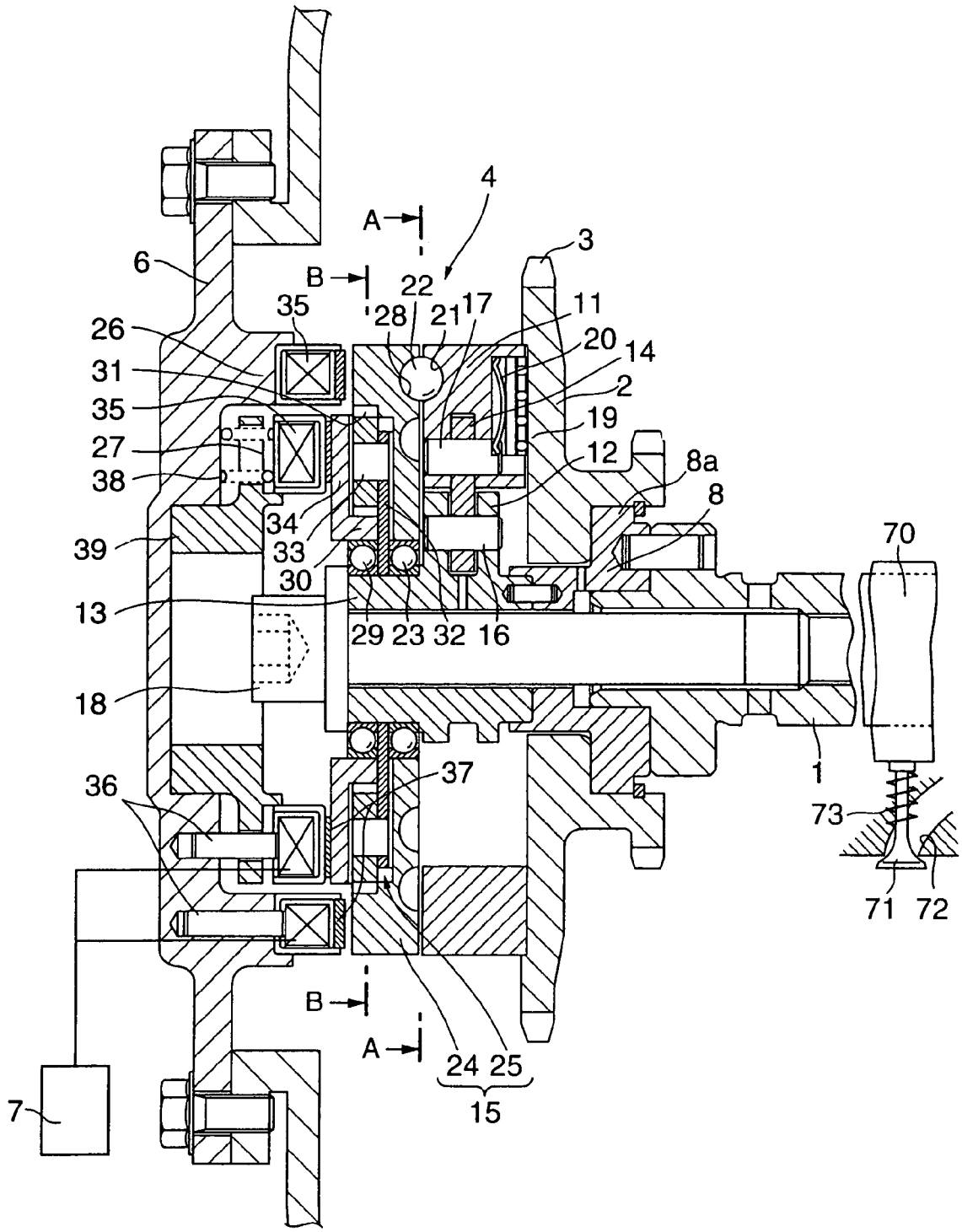
FIG. 1 is a cross-sectional view illustrating a first embodiment of the invention.

The present invention will be hereinbelow described in detail in reference to the drawings.

First of all, the device of the first embodiment is described hereunder in reference to FIGS. 1 through 5. The valve timing control device of the first embodiment is exemplified in an intake valve of an internal combustion engine, but, in the same manner as the intake valve side, the device of the embodiment can be applied to an exhaust valve.

The valve timing control device includes an engine valve 71 provided at an intake port 72 of the engine to open and close the intake port 72, a valve spring 73 biasing the engine valve 71 in a direction intake port 72 closes, a camshaft 1 rotatably supported on a cylinder head of the engine and having a cam 70 formed on an outer periphery thereof and used to drive the intake valve, a disc-shaped driving plate 2 (a driving rotational member) rotatably installed on a front end of camshaft 1, a timing sprocket 3 formed on driving plate 2 and driven by a crankshaft (not shown) of the engine, an installation-angle adjusting mechanism 4 disposed between the front end of camshaft 1 and a front end of driving plate 2 to variably adjust an installation angle between camshaft 1 and driving plate 2, a VTC cover 6 extending from a front end face of the cylinder head (not shown) to a front end face of a rocker cover (not shown) to hermetically cover driving plate 2, the front face of installation-angle adjusting mechanism 4, and their peripheries, and a controller 7 controlling installation-angle adjusting mechanism 4 depending upon engine operating conditions.

A spacer 8, having an engageable flanged portion 8*a*, is installed and integrally connected to the front end of camshaft 1. Drive plate 2 is engaged with flanged portion 8*a*, such that an axial displacement of the driving plate is restricted by means of engagement between the driving plate and flanged portion 8*a*, but the driving plate is installed on the outer periphery of spacer 8 in a manner so as to be rotatable relative to the spacer. In the shown embodiment, the driven rotational member of the device of the invention is comprised of camshaft 1 and spacer 8, whereas the driving rotational member is comprised of driving plate 2 including timing sprocket 3.

Three circumferentially-equidistant-spaced radial guides 10, each including a pair of parallel guide walls 9*a* and 9*b*, are installed at the front end (the left-hand side face in FIG. 1) of driving plate 2. A movable operating member 11 (which will be fully described later) of installation-angle adjusting mechanism 4 is slidably installed and disposed between the guide walls 9*a* and 9*b* of each of the radial guides 10. As hereinafter described in detail, the guide walls 9*a* and 9*b* of radial guide 10 never extends in an accurate radial direction, but the guide walls serves to guide the movable operating member along the substantially radial direction. Thus, a block denoted by 10 will be hereinafter referred to as a "radial guide". In the shown embodiment, radial guide 10 and movable operating member 11 construct a first drive transmission means having a power transmitting feature.

Installation-angle adjusting mechanism 4 has three radially-extending, circumferentially-equidistant-spaced levers 12, and is constructed mainly by a lever shaft 13, fixedly connected onto the axial end of camshaft 1 together with the previously-noted spacer 8 by means of a bolt 18, the movable operating members 11 each having a substantially rectangular shape and slidably engaged with the associated radial guide 10, substantially circular-arc shaped link arms 14 each pivotably linking the associated one of levers 12 of lever shaft 13 to the associated one of movable operating members 11, and an actuator 15 moving the previously-noted movable operating members 11 in response to a control signal from a controller 7. In the drawing, reference sign 16 denotes a pin through which the inside end of link arm 14 is pin-connected to lever 12. Reference sign 17 denotes a pin through which the outside end of link arm 14 is pin-connected to movable operating member 11. Link arms 14 and levers 12 construct a rotational-direction conversion mechanism and a second drive transmission mechanism having a motion conversion feature.

In a state that movable operating members 11 are guided by radial guides 10 in the substantially radial directions, each of the movable operating members is connected or linked to camshaft 1 through the associated link arm 14 and lever 12 of lever shaft 13. Therefore, in presence of substantially radial displacements of movable operating members 11 along the respective radial guides 10 by an external force, drive plate 2 (timing sprocket 3) rotates relative to camshaft 1 by a phase angle based on the displacement of each of movable operating members 11, by way of motion-transmitting action of link arm 14 and lever 12 cooperating with each other.

Each of movable operating members 11 is installed in a state that, in the rear end face of each of the movable operating members, a roller 19 is spring-loaded towards driving plate 2 by means of a leaf spring 20. Each of movable operating members 11 is formed with a semi-spherical recessed portion 21 in a predetermined position of its front end face. A ball 22 is rotatably accommodated and held in recessed portion 21 such that almost half of ball 22 is projected forwards.

On the other hand, actuator 15 is comprised of a guide plate 24 rotatably supported on the front end of lever shaft 13 via a bearing 23 and capable of causing a radial displacement of each of movable operating members 11 by way of relative rotation of the guide plate to driving plate 2, and a speed-increasing-and-decreasing mechanism having a planetary gear mechanism 25 and a pair of electromagnetic brakes 26 and 27 for accelerating and decelerating rotary motion of guide plate 24 by virtue of the planetary gear mechanism and the electromagnetic brake pair.

Figure 2:
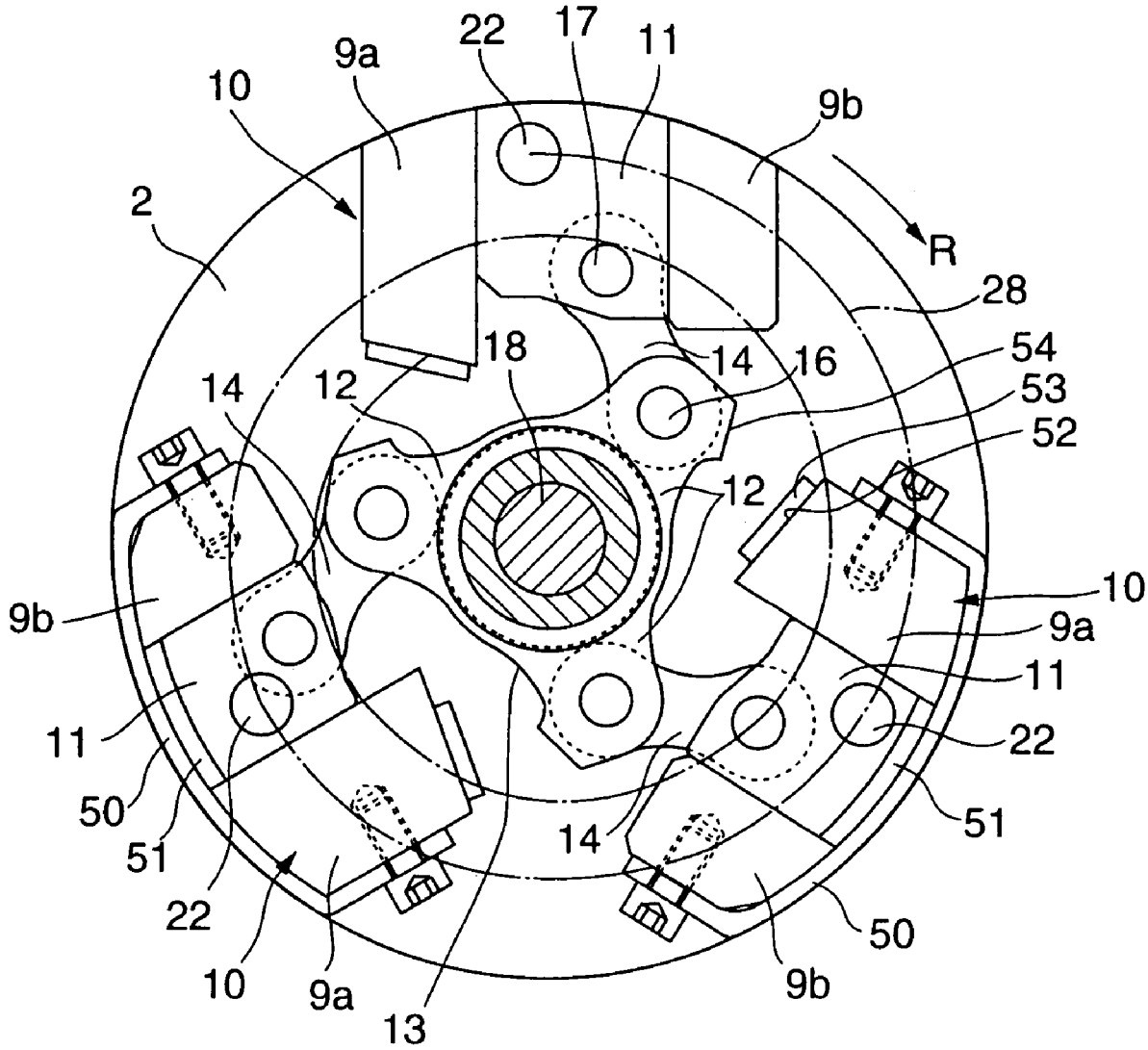
FIG. 2 is a cross-sectional view, taken along the line A-A of FIG. 1.

Guide plate 24 is formed on its rear face with a spiral guide groove 28 (a spiral guide). Balls 22 held in the respective movable operating members 11, are engaged with spiral guide groove 28. As shown in FIG. 2 in which only the center line of guide groove 28 is shown, the spiral of guide groove 28 is formed in such a manner that the diameter of the spiral reduces gradually in a rotational direction R of driving plate 2. Suppose guide plate 24 rotates in a phase-retard direction relative to driving plate 2 in a state that balls 22 of movable operating members 11 are in engagement with spiral guide groove 28. At this time, movable operating members 11 move radially inwards along the spiral shape of guide groove 28. Conversely when guide plate 24 relatively rotates in a phase-advance direction from this state, movable operating members 11 move radially outwards along the spiral shape of guide groove 28.

Figure 4:
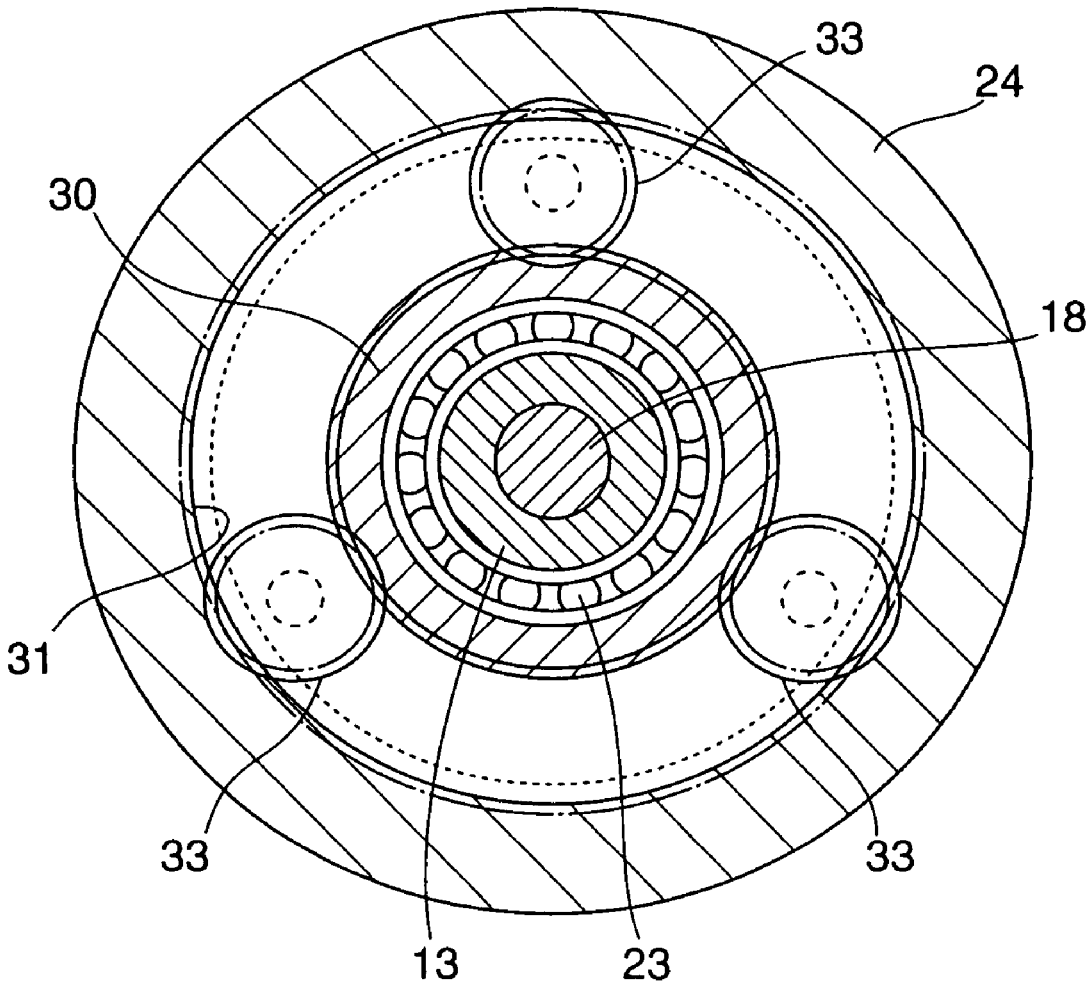
FIG. 4 is a cross-sectional view, taken along the line B-B of FIG. 1.

As shown in FIGS. 1 and 4, planetary gear mechanism 25 is comprised of a sun gear 30 rotatably supported on the front end portion of lever shaft 13 by means of a bearing 29, a ring gear 31 formed on the inner peripheral wall surface of a recessed portion provided on the front end portion of guide plate 24, a carrier plate 32 located between bearings 23 and 29 and fixedly connected to lever shaft 13, and a plurality of planetary gears 33 rotatably supported by carrier plate 32 and being in meshed-engagement with both sun gear 30 and ring gear 31.

Thus, assuming that, in the planetary gear mechanism 25, sun gear 30 is free to rotate and planetary gears 33 revolve together with carrier plate 32 without rotation of each of the planetary gears, carrier plate 32 and ring gear 31 rotate at the same speed. Under this condition, when a braking force is applied to only the sun gear 30, sun gear 30 rotates relative to carrier plate 32, and as a result planetary gears 33 themselves rotate. Rotation of each of planetary gears 33 causes ring gear 31 to accelerate, thus resulting in relative rotation of guide plate 24 to driving plate 2 toward the speed-increasing side.

Each of electromagnetic brakes 26 and 27 is substantially annular in shape. One electromagnetic brake 26 is located radially inside of the other electromagnetic brake 27. The first electromagnetic brake 26 located outside and the second electromagnetic brake 27 located inside are constructed in a substantially same manner. First electromagnetic brake 26 faces the perimeter of the front end face of guide plate 24, whereas second electromagnetic brake 27 faces a braking flange 34 integrally formed with sun gear 30.

Each of electromagnetic brakes 26 and 27 includes a substantially annular magnetic-force generator 35 having an electromagnetic coil and a yoke. The magnetic-force generators are supported on the rear face of VTC cover 6 in a floating state that only the rotary motion of each of the magnetic-force generators is restricted by way of a pin 36. A friction material 37 is provided on one side wall surface (facing guide plate 24) of each of magnetic-force generators 35. By energizing or de-energizing magnetic-force generators 35, the friction material 37 facing guide plate 24 is brought into contact with the guide plate or the friction material facing braking flange 34 is brought into contact with the braking flange. Concretely, of these electromagnetic-force generators 35, only the electromagnetic-force generator associated with second electromagnetic brake 27 is spring-loaded in a direction of braking flange 34 by way of the spring bias of a spring 38. That is, the first and second electromagnetic brakes are designed so that the friction material 37 of first electromagnetic brake 26 comes into contact with guide plate 24 when energizing the first electromagnetic brake, and so that the friction material 37 of second electromagnetic brake 27 gets out of contact with braking flange 34 when energizing the second electromagnetic brake. Therefore, in an engine stopped state (in an initial state), that is, in a de-energized state, the braking force acts upon only the sun gear 30.

Axial movement of electromagnetic-force generator 35 of second electromagnetic brake 27 is guided by a retainer ring 39 installed on the rear face of VTC cover 6. This retainer ring 39 is made of magnetic material, and thus serves as a magnetic-flux path when energizing second electromagnetic brake 27.

A driving torque is transmitted from driving plate 2 through movable operating members 11, link arms 14, and levers 12 to camshaft 1. On the other hand, fluctuating torque (alternating torque) of camshaft 1, occurring owing to reaction force caused by engine valve 71 (i.e., reaction caused by valve spring 73), is input from camshaft 1 to each of movable operating members 11 via the outwardly extruding end of the associated lever 12 and link arm 14, as an input force F acting in a direction that the input force passes through pivotal points or linked points of both ends of the same arm 14.

Movable operating members 11 are guided along the substantially radial direction by means of the respective radial guides 10. On the other hand, balls 22, held by the respective movable operating members 11 in a manner so as to project from the front face, are engaged with spiral guide groove 28 of guide plate 24. Therefore, the force F input from the outwardly extruding end of each of levers 12 into the movable operating member through the associated link arm 14, is received or supported by guide walls 9*a* and 9*b* of radial guide 10, and spiral guide groove 28 of guide plate 24. In other words, each of movable operating members 11 is equipped with a side wall surface a (a first guided surface) that receives the force caused by fluctuating torque, that is, reaction of force F, while making contact with either of the guide walls 9*a* and 9*b*, and a partial surface b of ball 22 (a second guided surface) that receives the force caused by fluctuating torque, that is, reaction of force F, while making contact with spiral guide groove 28 of guide plate 24 (see FIG. 5).

Figure 5:
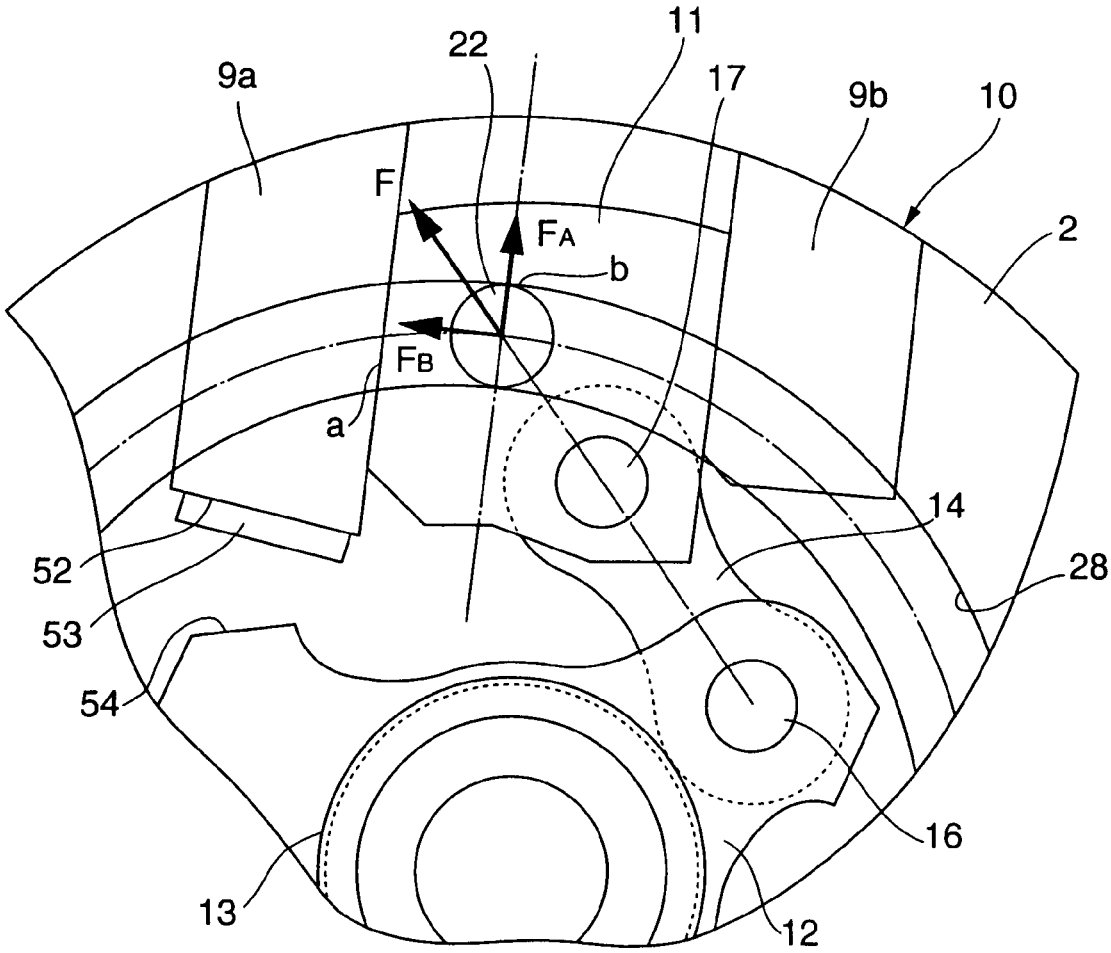
FIG. 5 is an enlarged cross-sectional view illustrating an essential part of the device of FIG. 2.

As can be seen from the enlarged view of FIG. 5, guide walls 9*a* and 9*b*, constructing radial guide 10, are laid out such that the guide walls are inclined in a direction that the spiral of spiral guide groove 28 is converging, with respect to the radial direction of driving plate 2. Concretely, the inclination of guide walls 9*a* and 9*b* is set so that the guide walls are oriented substantially in a normal-line direction perpendicular to a spiral curved wall surface of spiral guide groove 28. Thus, spiral guide groove 28 and guide wall pair 9*a*, 9*b* are substantially perpendicular to each other, and as a result the side wall surface a of each of movable operating members 11, being in contact with either of the guide walls, and the partial surface b of ball 22, being in contact with spiral guide groove 28, are substantially perpendicular to each other. As regards the relationship between the layout or installation point of ball 22 on each of movable operating members 11 and the pivotal points of the associated link arm 14, the center of ball 22 is substantially in alignment with the line of action of the force F input from lever shaft 13 into movable operating member 11. Actually, the orientation of the line of action of the force passing through the pivotal points of link arm 14 varies owing to the radial displacement of movable operating member 11. However, the installation position of ball 22 is set not to be offset from the line of action of force F as much as possible. Concretely, as shown in FIG. 5, when the radial position of movable operating member 11 becomes almost half of its full stroke, the ball 22 is located on the line of action of force F.

Therefore, force F input into movable operating member 11 is resolved into two components $F_A$ and $F_B$ which are perpendicular to each other. These components $F_A$ and $F_B$ are received by almost one half of inward and outward curved walls of spiral guide groove 28 in a direction substantially perpendicular to the component acting along the substantially normal-line direction and by the guide wall 9*a* in a direction substantially perpendicular to the direction of action of the component acting the substantially tangential direction of the spiral, respectively. In this manner, it is possible to certainly prevent motion of movable operating member 11. The direction of action of force F is not limited to the direction of action shown in FIG. 5 in which the force acts to push movable operating member 11 through lever 12. In contrast, the force also acts to pull movable operating member 11 by lever 12. In this case, the components are received by almost the other half of inward and outward curved walls of spiral guide groove 28 and by the other guide wall 9*b*, respectively.

It is impossible to accurately set the directions of the components in such a manner that the direction of action of component $F_A$ and spiral guide groove 28 accurately cross perpendicular to each other and that the direction of action of component $F_B$ and guide walls 9*a* and 9*b* of radial guide 10 accurately cross perpendicular to each other, all over the operating range of movable operating member 11. However, it is possible to set the directions of action of components $F_A$ and $F_B$ within a specified angular range, such that movable operating member 11 can be certainly supported by virtue of friction created due to contact with spiral guide groove 28 and guide walls 9*a* and 9*b* irrespective of the presence of action of force F.

Figure 3:
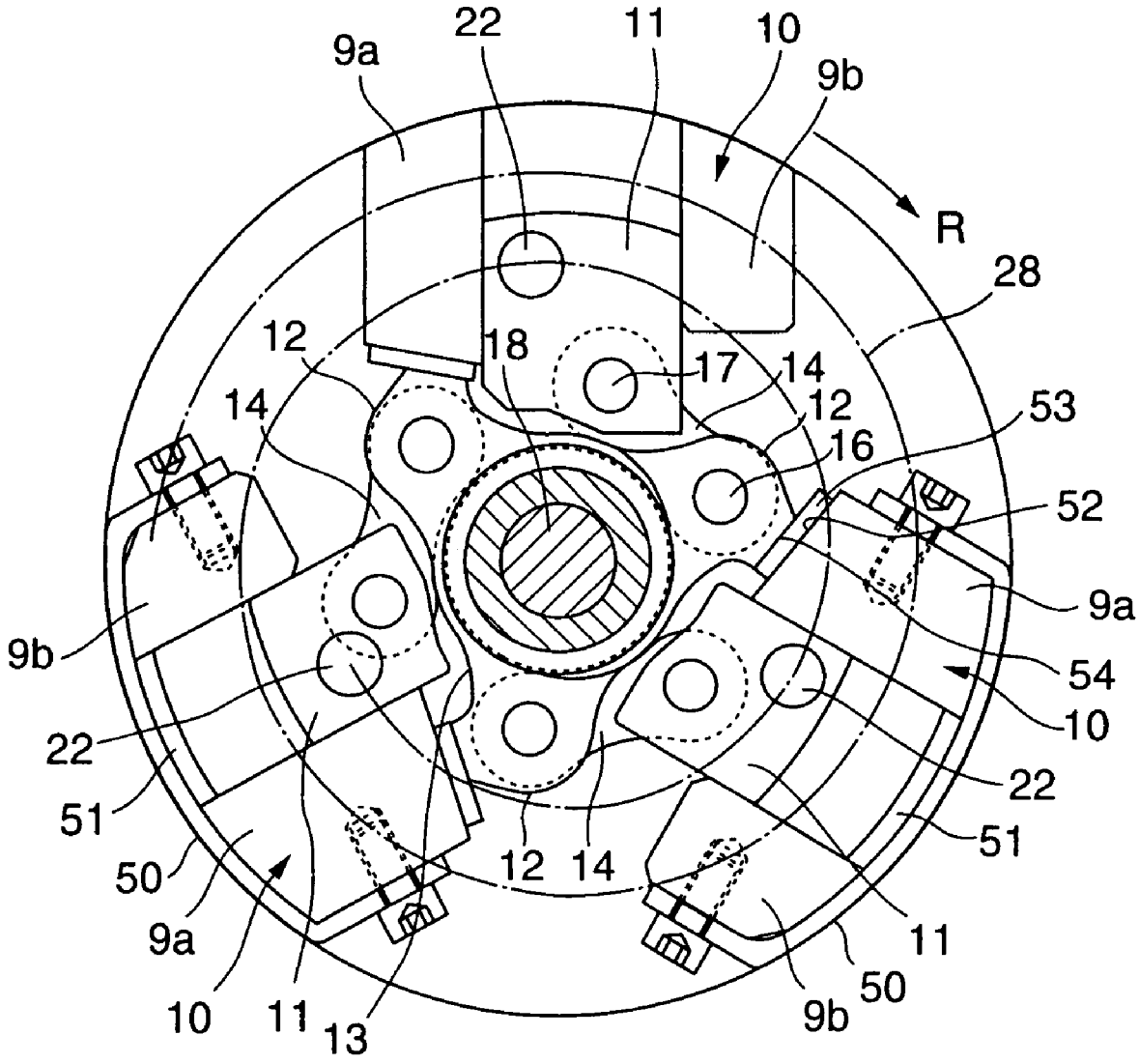
FIG. 3 is almost the same cross-sectional view as FIG. 2, and showing the operation of the device of the embodiment.

Additionally, as shown in FIGS. 2 and 3, a stopper 50 (a restricting mechanism) is installed on each of the two radial guides of the three radial guides 10, so that the stopper extends from one of outermost ends of guide walls 9*a* and 9*b* to the other. Stopper 50 is a portion with which the outermost end of movable operating member 11 is brought into abutted-engagement, when driving plate 2 rotates relative to camshaft 1 and the maximum phase-retard position shown in FIG. 2 is reached, that is, when the relative-rotation phase reaches a substantially maximum value in the phase-retard direction. A cushioning material 51 (a cushioning mechanism) made of acrylonitrile-butadiene rubber (NBR), fluorine-contained rubber, acrylic rubber, or the like, is provided on the abutted surface of stopper 50.

Furthermore, a protruded stopper 54 (a restricting mechanism) is provided at the outwardly extruding end of each of levers 12 to which the inside end of the link arm 14 is connected. Stopper 54 is brought into abutted-contact with the innermost end of guide wall 9*a* of radial guide 10, when driving plate 2 rotates relative to camshaft 1 and the maximum phase-advance position shown in FIG. 3 is reached, that is, when the relative-rotation phase reaches a substantially maximum value in the phase-advance direction. A cushioning material 53 similar to the previously-noted cushioning material 51 is provided on the innermost end of guide wall 9*a*.

Hereunder described in detail is the operation of the device of the embodiment.

During a starting period of the engine, or during idling, first and second electromagnetic brakes 26 and 27 are both de-energized in response to control signals from controller 7. Friction material 37 of second electromagnetic brake 27 is in frictional contact with braking flange 34. For this reason, the braking force acts on sun gear 30 of planetary gear mechanism 25, and thus guide plate 24 is rotated toward the speed-increasing side. Therefore, movable operating member 11 is held at its radially outward end. As a result of this, lever shaft 13, linked to each of movable operating members 11 via link arms 14 and levers 12, (that is, camshaft 1) is maintained at an installation angle corresponding to the maximum phase-retard position relative to driving plate 2.

Therefore, at this time, the rotational phase of camshaft 1 relative to the crankshaft can be controlled to the maximum phase-retard position, and thus the engine speed can be stabilized and fuel economy can be improved.

When shifting from the previously-noted operating condition to the normal engine operating condition, first and second electromagnetic brakes 26 and 27 are both energized in response to control signals from controller 7. Thus, friction material 37 of first electromagnetic brake 26 is brought into contact with guide plate 24, while friction material 37 of second electromagnetic brake 27 gets out of contact with braking flange 34 of sun gear 30. As a result, sun gear becomes free to rotate, while the braking force acts on guide plate 24, thus resulting in relative rotation of guide plate 24 to driving plate 2 toward the speed-increasing side. As a result of this, balls 22 of movable operating members 11 are guided toward the center of the spiral of guide groove 28 of guide plate 24, and thus the movable operating members 11 move radially inwards as shown in FIG. 3. At this time, the link arms 14 pivoted to the respective movable operating members 11 force the levers 12 to move in the rotational direction corresponding to the phase advance, with the result that the installation angle between driving plate 2 and camshaft 1 is changed to the phase-advance side.

In this manner, as soon as driving plate 2 and camshaft 1 relatively rotate to their maximum phase-advance positions, stopper 54 of the outwardly extruding end of each of levers 12 abuts the innermost end 52 of guide wall 9*a* via cushioning material 53, thus preventing further relative-rotation between both of the driving plate and the camshaft. At this time, the rotational phase of camshaft 1 relative to the crankshaft can be controlled to the maximum phase-advance position, and thus ensuring high engine power output.

When controlling the rotational phase between the crankshaft and camshaft 1 to the phase-retard side from this operating condition, first and second electromagnetic brakes 26 and 27 are both de-energized again in response to control signals from controller 7, and therefore, only the friction material 37 of second electromagnetic brake 27 is brought into frictional contact with braking flange 34. Thus, the braking force acts on sun gear 30 of planetary gear mechanism 25, and guide plate 24 is rotated toward the speed-increasing side. Movable operating members 11 move radially outwards. As a result, as shown in FIG. 2, levers 12 are pulled back by the respective link arms 14, and thus the installation angle between driving plate 2 and camshaft 1 is changed to the phase-retard side.

The valve timing control device disclosed in the Japanese Patent Provisional Publication No. 10-153104 is designed so that the piston member (the movable operating member) of the installation-angle adjusting mechanism is operated to move along the axial direction of the camshaft. This increases the installation space occupied by the installation-angle adjusting mechanism mounted on the front end of the camshaft, thereby increasing the axial length of the engine and deteriorating the ease of assembly. In particular, in case that the axial displacement of the piston member is varied or controlled by way of an electromagnet, the electromagnet must be arranged axially outside of the range of full stroke of the piston member. In an automotive vehicle having a comparatively small engine mounting space in the axial direction, it is impossible to mount the engine on such a vehicle.

In contrast to the above, in the valve timing control device of the embodiment, movable operating member 11 can be guided or displaced along the associated guide walls 9*a* and 9*b* in the substantially radial direction of driving plate 2. Additionally, the radial displacement of movable operating member 11 is converted into relative rotation between driving plate 2 and camshaft 1 via the link mechanism including link arms 14 and levers 12. Thus, the device of the embodiment can make an accurate phase control while providing a compact structure that reduces the axial installation space. As discussed above, the entire axial length of the device can be largely reduced as compared to the conventional device, thereby enhancing the ease of mounting of the engine on the vehicle.

Also, in the conventional valve timing control device as discussed above, the rotational phase is held against the reaction (the alternating torque) caused by the engine valve. For this reason, an electromagnetic clutch used to hold the rotational phase has to be provided separately from the movable operating member (the piston member). The structure of the electromagnetic clutch used to hold the rotational phase is complicated, and thus it is necessary to use expensive electromagnetic parts. As a whole, the device is very expensive. Moreover, the electromagnetic clutch is kept energized while the clutch is released. This undesirably increases electrical power consumption which is valuable for automotive vehicles.

In contrast, in the valve timing control device of the embodiment, force F, occurring owing to the reaction created by the engine valve, and input into movable operating member 11 via the associated link arm 14, can be distributed into or supported by the guide walls 9*a*, 9*b* of radial guide 10 and the spiral guide groove 28, with no displacement of movable operating member 11.

That is, in this device, the guide walls 9*a*, 9*b* (guide surfaces) of radial guide 10 which serves to guide the side wall surface a, are inclined in the direction that the spiral of spiral guide groove 28 is converging, with respect to the radial direction of camshaft 1. Thus, the components $F_A$, $F_B$ of force F input from link arm 14 to movable operating member 11 can be received by guide walls 9*a*, 9*b* in the substantially perpendicular direction of each of the guide walls. As a result, by virtue of the reaction force of the abutted portions between the side wall surface a of movable operating member 11 and guide walls 9*a*, 9*b*, and the reaction of the abutted portion between the partial surface b of ball 22 and spiral guide groove 28, it is possible to certainly prevent the displacement of movable operating member 11 which may occur owing to the fluctuating torque of camshaft 1.

The first factor for restriction of the displacement of the movable operating member is that the guiding surface and the guided surface cross substantially perpendicular to each other with respect to the direction of action of the force. The other factor more certainly restricting the displacement of the movable operating member is that force F is resolved into components $F_A$ and $F_B$, and that the components $F_A$ and $F_B$ are received respectively by the two contact surfaces substantially perpendicular to each other, namely the contact surface between the guiding surface and first guided surface and the contact surface between the guiding surface and second guided surface, in their substantially perpendicular directions.

Therefore, according to the device of the embodiment, it is possible to prevent the positive and negative fluctuations of camshaft 1 to driving plate 2, occurring owing to the reaction force caused by the engine valve, without using the complicated structure and expensive electromagnetic parts. Therefore, as compared to the conventional device having the same function, in the device of the embodiment its structure can be simplified, thus reduce manufacturing costs. Additionally, it is possible to maintain the rotational phase without using an electromagnetic force, thus reducing electrical power consumption which is valuable for automotive vehicles.

In the valve timing control device of the embodiment, when the relative phase between driving plate 2 and camshaft 1 has to be changed to an arbitrary rotational phase, the movable operating member 11 is displaced or moved to a desired or predetermined position by properly switching electromagnetic brakes 26 and 27 on and off, and under this condition the friction materials of both of the electromagnetic brakes are merely kept apart from the opposite members.

In this case, it is necessary to energize one of the electromagnetic brakes, that is, electromagnetic brake 27 so as to keep the friction materials apart from the opposite members, however, electromagnetic brakes 26 and 27 never function to directly press down movable operating member 11 and to prevent the displacement of the movable operating member. Therefore, it is unnecessary to continue to supply great electrical power, thus ensuring reduced electrical fuel consumption.

Furthermore, in the valve timing control device of the embodiment, when the relative position between driving plate 2 and camshaft 1 in the rotational direction reaches the maximum phase-retard position, the full face of the outermost end of movable operating member 11 is brought into abutted-contact with stopper 50. Conversely, when the relative position reaches the maximum phase-advance position, protruded stopper 54 of each of levers 12, provided at the connected portion to each of link arms 14, is brought into abutted-contact with the innermost end of guide wall 9*a*. These members are brought into contact with the opposing members with a wide contact surface area, thus reducing the bearing pressure of the abutted-contact portion. In particular, in the shown embodiment, the opposing members of stoppers 50 are provided on the plurality of movable operating members 11, operating in synchronization with each other, whereas stoppers 54 are provided on the plurality of levers 12, operating in synchronization with each other. Thus, it is possible to widen the whole contact surface area of stoppers 50 and 54, thereby ensuring reduced bearing pressure.

In addition to the above, cushioning member 51 is provided between stopper 50 and the opposing member, while cushioning member 53 is provided between stopper 54 and the opposing member. Thus, by way of the cushioning function of the cushioning members 51 and 53, it is possible to prevent noises to occur during operation of each of the stoppers 50 and 54.

Figure 6:
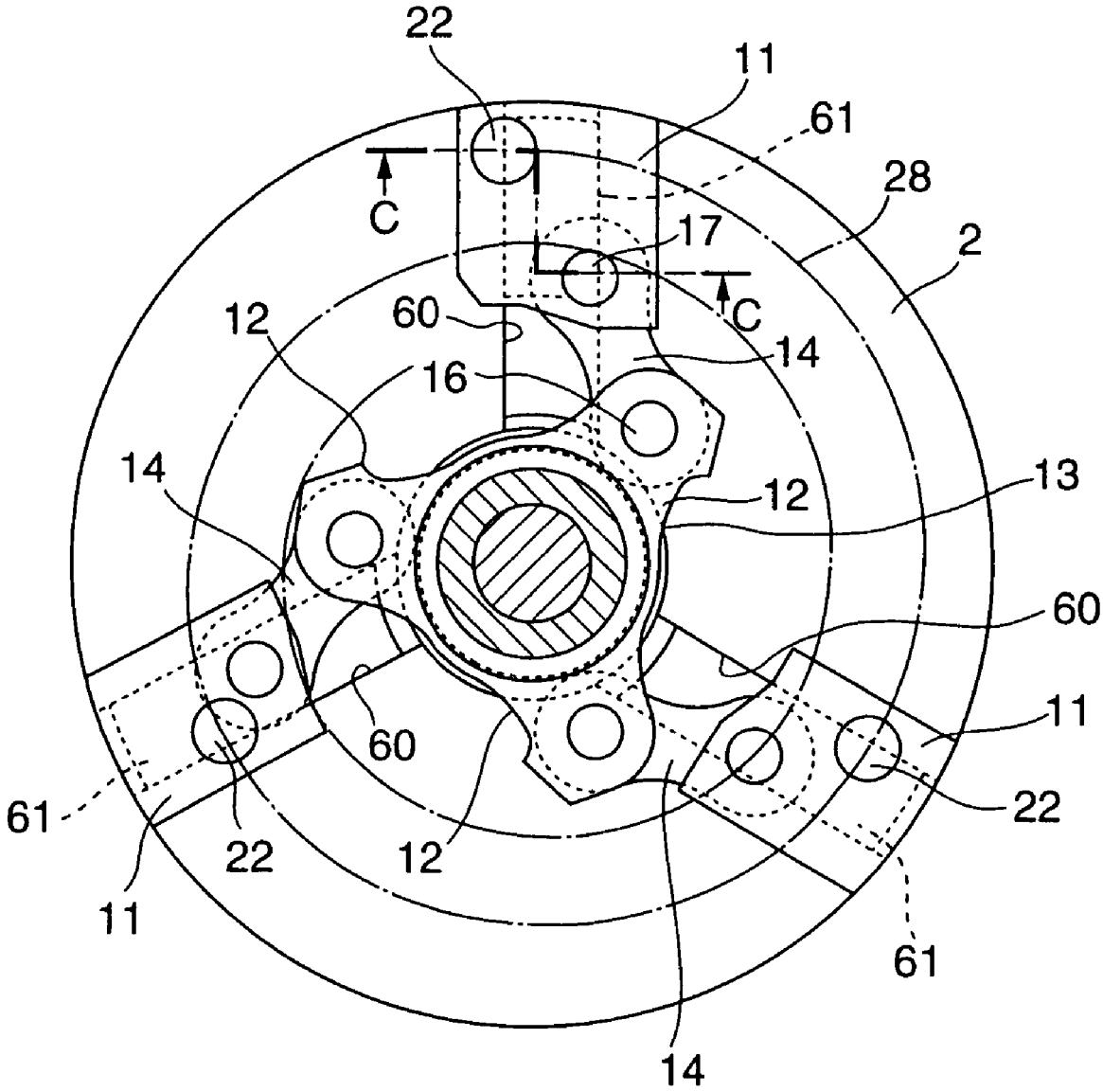
FIG. 6 is a cross-sectional view illustrating a second embodiment of the invention, modified as compared to the device of FIG. 2.
Figure 7:
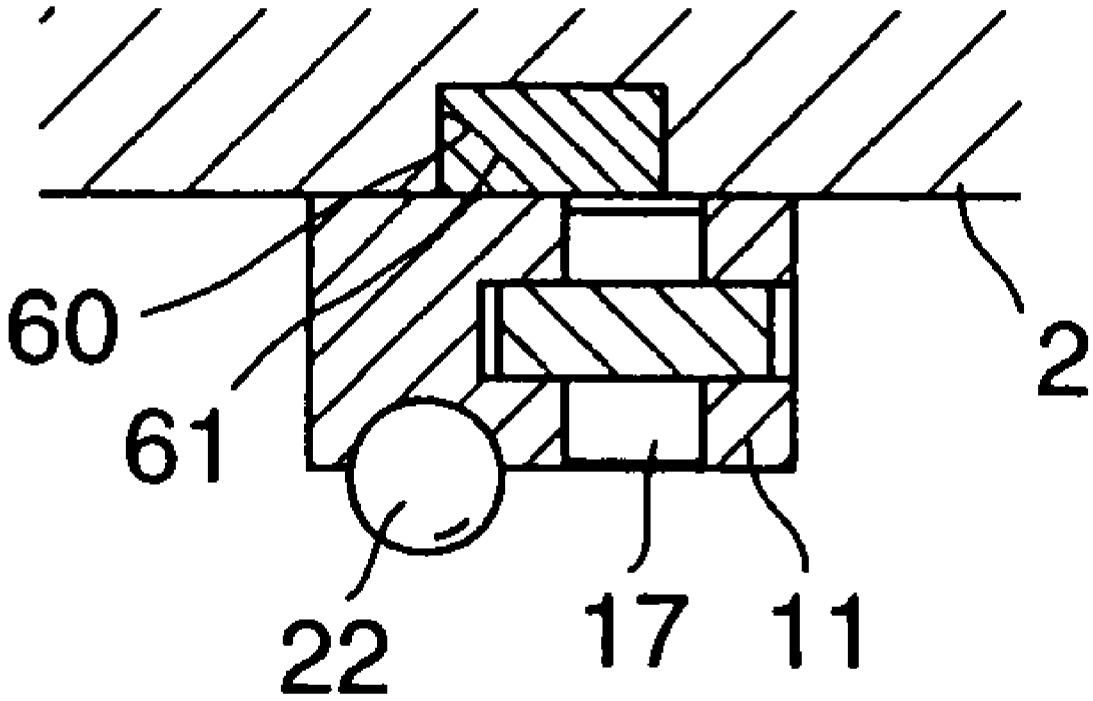
FIG. 7 is a cross-sectional view taken along the line C-C of FIG. 6.

Referring to FIGS. 6 and 7, there is shown the second embodiment of the invention.

The fundamental structure of the second embodiment is similar to that of the first embodiment. Only the structure of the radial guiding portion of the device of the second embodiment which guides movable operating member 11 in the substantially radial direction, is different from that of the first embodiment. For the purpose of simplification of the disclosure, the same reference signs used to designate elements shown in the first embodiment will be applied to the corresponding elements shown in the second embodiment, while detailed description of the same elements will be omitted because the above description thereon seems to be self-explanatory.

In the radial guide of the second embodiment, a guide groove 60 is formed in driving plate 2 in such a manner that the guide groove is slightly inclined in a direction that the spiral of spiral guide groove 28 is converging, with respect to the radial direction. Movable operating member 11 is formed with a protruded portion 61 which is slidably engaged with guide groove 60. The device of the second embodiment basically functions in the same manner as the first embodiment, so that the components of the force input through link arm 14 into movable operating member can be received by the previously-noted guide groove 60 and spiral guide groove 28 in their substantially perpendicular directions. In the second embodiment, it is possible to eliminate the guide walls provided at the front face of driving plate 2, thus down-sizing and lightening the device itself.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

The invention claimed is:

1. A valve timing control device for an internal combustion engine comprising:

a driving rotational member driven by a crankshaft of the engine;

a driven rotational member connected to an intake camshaft to transmit a torque from the driving rotational member to the driven rotational member;

a plate rotatable relative to each of the driving and driven rotational members, the plate having a guide whose diameter reduces in a circumferential direction;

an installation-angle adjusting mechanism comprising a movable operating member engaged with the guide to be displaceable along the guide, for varying an installation angle between the driving and driven rotational members by way of movement of the movable operating member in a substantially radial direction of the camshaft; and a speed increasing-and-decreasing mechanism adapted to adjust the installation angle between the driving and driven rotational members by way of the radial movement of the movable operating member created by accelerating and decelerating rotary motion of the plate with respect to the driving rotational member depending on an energizing-and-deenergizing state of an electromagnetic-force generator, the plate being rotated to adjust the installation angle between the driving and driven rotational members to a phase-retard side, when the electromagnetic-force generator is kept in its deenergized state.

2. A valve timing control device as claimed in claim 1, wherein the guide comprises a groove formed in the plate.

3. A valve timing control device as claimed in claim 1, wherein the movable operating member and the driven rotational member are mechanically linked to each other via a link.

4. A valve timing control device as claimed in claim 1, wherein the movable operating member is configured to be in rolling contact with the driving rotational member.

5. A valve timing control device for an internal combustion engine employing a driving rotational member driven by a crankshaft of the engine and a driven rotational member connected to an intake camshaft to transmit a torque from the driving rotational member to the driven rotational member, the valve timing control device capable of variably controlling a relative-rotation phase between the crankshaft and the camshaft depending on engine operating conditions, comprising:

a movable operating member being guided to be movable inwardly and outwardly;

a plate having a guide whose diameter reduces in a circumferential direction, the plate configured to be rotatable relative to at least the driving rotational member, the guide and the movable operating member in engagement with each other;

an installation-angle adjusting mechanism adapted to variably control the relative-rotation phase between the crankshaft and the camshaft by way of inward-and-outward movement of the movable operating member along the guide; and a speed increasing-and-decreasing mechanism adapted to adjust an installation angle of the driven rotational member relative to the driving rotational member by way of a displacement of the movable operating member along the guide created by accelerating and decelerating rotary motion of the plate with respect to the driving rotational member depending on an energizing-and-deenergizing state of an electromagnetic-force generator, a braking force being applied to the plate to adjust the installation angle between the driving and driven rotational members to a phase-retard side, when the electromagnetic-force generator is kept in its deenergized state.

6. A valve timing control device as claimed in claim 5, wherein the guide comprises a groove formed in the plate.

7. A valve timing control device as claimed in claim 5, wherein the movable operating member and the driven rotational member are mechanically linked to each other via a link.

8. A valve timing control device as claimed in claim 5, wherein the movable operating member is configured to be in rolling contact with the driving rotational member.

9. A valve timing control device for an internal combustion engine employing a driving rotational member driven by a crankshaft of the engine and a driven rotational member connected to a camshaft to transmit a torque from the driving rotational member to the driven rotational member, the valve timing control device capable of variably controlling a relative-rotation phase between the crankshaft and the camshaft depending on engine operating conditions, comprising:

an installation-angle adjusting mechanism adapted to vary the relative-rotation phase between the crankshaft and the camshaft, and comprising a fluctuation restricting mechanism that restricts fluctuating movement of the driving rotational member, occurring owing to alternating torque transmitted from the camshaft; and a speed increasing-and-decreasing mechanism adapted to variably control the installation-angle adjusting mechanism depending on an energizing-and-deenergizing state of an electromagnetic-force generator, wherein the installation-angle adjusting mechanism is operated to adjust the installation angle between the driving and driven rotational members to a phase-retard side, when the electromagnetic-force generator is kept in its deenergized state, and wherein the fluctuation restricting mechanism comprises a plate having a guide whose diameter reduces in a circumferential direction, a movable operating member engaged with the guide to be displaceable along the guide, and a link via which the driven rotational member and the movable operating member are pivotably connected to each other.

10. A valve timing control device as claimed in claim 9, wherein the guide comprises a groove formed in the plate.

11. A valve timing control device as claimed in claim 9, wherein the movable operating member is configured to be in rolling-contact with the driving rotational member.

* * * * *